United States Patent [19]

Matsumoto

[11] Patent Number: 4,884,984

[45] Date of Patent: Dec. 5, 1989

[54] CRIMP CONNECTOR AND METHOD OF ATTACHING WIRE TO IT

[75] Inventor: Masatsugu Matsumoto, Tokyo, Japan

[73] Assignee: Create System Co., Ltd., Tokyo, Japan

[21] Appl. No.: 291,741

[22] Filed: Dec. 29, 1988

[30] Foreign Application Priority Data

Mar. 12, 1988 [JP] Japan ..... 63-58879

[51] Int. Cl.[4] ..... H01R 4/10

[52] U.S. Cl. ..... 439/877; 439/442; 29/865

[58] Field of Search ..... 29/863, 865, 866; 439/877, 880, 881, 882, 430, 442, 444

[56] References Cited

U.S. PATENT DOCUMENTS

| | | | |
|---|---|---|---|
| 3,221,290 | 11/1965 | Stark et al. | 439/877 |
| 3,864,013 | 2/1975 | Levy | 439/880 |
| 3,909,935 | 10/1925 | Aldridge et al. | 29/866 |
| 4,298,243 | 11/1981 | Swengel, Jr. et al. | 439/881 |
| 4,411,484 | 10/1983 | Casey | 29/866 |

FOREIGN PATENT DOCUMENTS

| | | | |
|---|---|---|---|
| 924920 | 5/1963 | United Kingdom | 439/882 |

*Primary Examiner*—David Pirlot

*Attorney, Agent, or Firm*—Frishauf, Holtz, Goodman & Woodward

[57] ABSTRACT

A crimp connector, comprising a socket housing having received therein a crimp terminal comprising a contact, a pair of claws for holding a stripped portion of a wire, and a pair of claws for holding an unstripped portion of the wire, said housing being provided; at the front end face thereof with an opening or said contact; at the top thereof with an opening through which the wire is inserted and crimpers to crimp the stripped portion holding claws and the unstripped portion holding claws are inserted; and at the bottom thereof with an opening through which an anvil to crimp said stripped portion holding claws is inserted. A method of attaching electric wires to the crimp connector is also disclosed. The present crimp connector makes it possible to attach wires in the state that crimp terminals have been built in a socket housing.

6 Claims, 5 Drawing Sheets

CRIMP CONNECTOR AND METHOD OF ATTACHING WIRE TO IT

FIELD OF THE INVENTION

The present invention relates to a crimp connector comprising a crimp terminal received in a socket housing, and a method of attaching an end of an electric wire to this crimp connector.

BACKGROUND OF THE INVENTION

Various types of connectors have hitherto been used to provide electrical junction between electric circuits or electrical equipments. In general, these connectors are comprised of an insulating socket housing that holds therein a terminal having a wire-connecting portion and a contact. In this instance, the contact includes a male contact and a female contact, which are engaged with each other to make an electrical connection.

known as terminals used in the connectors as set out above are crimp terminals having the structure that the wire-connecting portion has crimped the core (bared portion) of a stripped wire, and insulation displacement terminals having the structure that the wire-connecting portion makes an electrical connection by forcing the wire into a U-contact to cut through its cover at that portion to make contact with the wire.

The insulation displacement terminals are connected to the wire generally in the state that they have been built in a socket housing. More specifically, a wire is forced into the U-contact of the insulation displacement terminal through an opening of the socket housing, and the cover of the wire is cut through so that the U-contact may be brought into contact with the core of the wire. Thus, insulation displacement connectors having the insulation displacement terminals can be very simplified in the operation to secure them to wires, enabling the securing operation to be automatized with ease.

Since, however, the insulation displacement connectors make an electrical connection by forcing the wire into the U-contact with its cover unremoved, they have had disadvantages that the reliability against conduction poorness is not sufficient and also they can not be applied for electric currents having a large capacity. For this reason, under the existing conditions, the crimp connectors are more widely still utilized than the insulation displacement connectors.

On the other hand, to describe the crimp connectors taking an example as illustrated in FIG. 6, a crimp terminal 11 comprises a contact 12 (a female contact in this example), a core (stripped portion) holding claw 13, a wire (unstripped portion) holding claw 14, and a hook 15 to catch the socket housing. A wire 21 is provided in the state that a cover 22 is removed at its end portion with a core 23 exposed. Also, the stripped portion holding claw 13 and the unstripped portion holding claw 14 are crimped by means of an anvil and a pair of crimping teeth, called crimpers, of a terminal-crimping machine (not shown) so that the core (stripped portion) 23 and the cover (unstripped portion) 22 may be respectively held with the claws.

After the crimp terminal 11 has been secured to the wire 21, the crimp terminal 11 is inserted to a socket housing 31 and received therein, as illustrated in FIG. 7. In this example, the respective crimp terminals 11 are secured to the wires 21 of a ribbon cable 24, and are received in the respective sections of the socket housing 31. Openings 32 at the front end face of the socket housing 31 are openings through which male contacts to be connected to the female contacts 21 of the crimp terminals 11 are inserted. When the crimp terminal 11 is of the type comprising a male contact, a pin of the male contact is projected from the above opening 32.

In this way, the crimp connector having the crimp terminal 11 crimps the core (stripped portion) 23 with the stripped portion holding claw 13, so that the electrical connection can be surely made, bringing about the advantage that it can be applied even for electric currents having a relatively large capacity.

However, in fabricating the crimp connector, two stages are required, comprising securing the crimp terminal 11 to an end of the wire 21 and thereafter inserting the crimp terminal 11 into the socket housing 31. Once the crimp terminal 11 has been secured to the wire 21, it is very difficult to mechanically automatize the operation to insert the terminal into the socket housing 31. Moreover, in instances in which a plurality of crimp terminals 11 are received in one socket housing 31, wires are required to be classified by color and must be set with precise arrangement. For this reason, under the existing conditions, the crimp terminals 11, after having been secured to the ends of wires 21, are manually inserted into the socket housing 31.

SUMMARY OF THE INVENTION

The present invention was made on account of the above problems involved in the prior art, and an object thereof is to provide a crimp connector capable of attaching wires in the state that crimp terminals have been built in a socket housing, and a method of attaching a wire to the crimp connector.

To achieve the above object, the crimp connector of the present invention comprises a socket housing having received therein a crimp terminal comprising a contact, at least a pair of claws for holding a stripped portion of a wire, and at least a pair of claws for holding an unstripped portion of the wire, said housing being provided;

at the front end face thereof with an opening for said contact;

at the top thereof with an opening through which the wire is inserted and crimpers to crimp the stripped portion holding claws and the unstripped portion holding claws are inserted; and at the bottom thereof with an opening through which an anvil to crimp said stripped portion holding claws is inserted.

The method of attaching a wire to the crimp connector is a method of attaching a wire to a crimp connector, comprising;

disposing a wire whose end portion has been stripped with a given length to have a stripped portion and an unstripped portion, to a crimp connector comprising a socket housing having received therein a contact, at least a pair of stripped portion holding claws and at least a pair of unstripped portion holding claws, in such a manner that the stripped portion may be positioned at an upper site of said stripped portion holding claws and the unstripped portion may be positioned at an upper site of said unstripped portion holding claws;

inserting an anvil to crimp said stripped portion holding claws, through a bottom opening provided at the bottom of said socket housing; and bringing an anvil to crimp said unstripped portion holding claws, into face-to-face contact with the bottom of said socket housing;

simultaneously inserting a crimper to crimp said stripped portion holding claws and a crimper to crimp said unstripped portion holding claws, through a top opening provided at the top of said socket housing, while forcing down said wire; and crimping said stripped portion holding claws so that said stripped portion of the wire may be held therewith, and crimping said unstripped portion holding claws so that said unstripped portion of the wire may be held therewith.

DESCRIPTION OF THE PREFERRED EMBODIMENTS

The wire is inserted from the top opening of the socket housing into its inside while being forced down by the crimper for the stripped portion holding claws and the crimper for the unstripped portion holding claws, so that the stripped portion of the wire is positioned between the stripped portion holding claws, and the unstripped portion of the wire, between the unstripped portion holding claws. Then, the stripped portion holding claws are crimped with the anvil for the stripped portion holding claws, which is inserted from the bottom opening of the socket housing, and with the crimper for the stripped portion holding claws, which is inserted from the top opening of the socket housing, so that the stripped portion of the wire is held with the stripped portion holding claws. In crimping the stripped portion holding claws, a strong pressure is applied, but no excessive stress is applied to the socket housing since both the crimper and anvil are inserted through the openings of the socket housing and directly act on the wire. Also, the unstripped portion holding claws are crimped by the anvil for the unstripped portion holding claws, which is brought into face-to-face contact with the bottom of the socket housing, and the crimper for the unstripped portion holding claws, which is inserted from the top opening of the socket housing, so that the unstripped portion of the wire is held with the unstripped portion holding claws. Here, although the anvil acts through the bottom wall of the socket housing, its pressing force is relieved by the resilience of the unstripped portion of the wire, thus preventing breakage of the socket housing. In this way, it is possible to control the openings to the minimum necessary size to maintain its function as an insulating cover to a practically difficulty-free extent. Hence, the present invention makes it possible to secure crimp terminals to wires in the state that crimp terminals have been built in a socket housing, so that the securing operation can be simplified and can be made suited to automatization.

Figure 6:
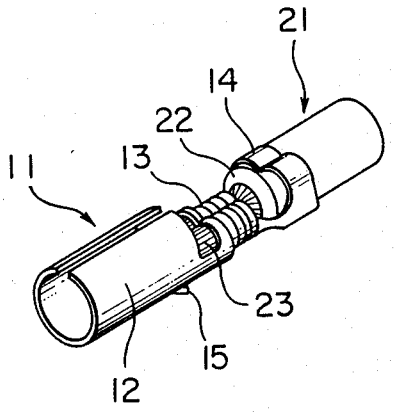
FIG. 6 is a perspective view illustrating how the conventional crimp terminal is secured to a wire.
Figure 7:
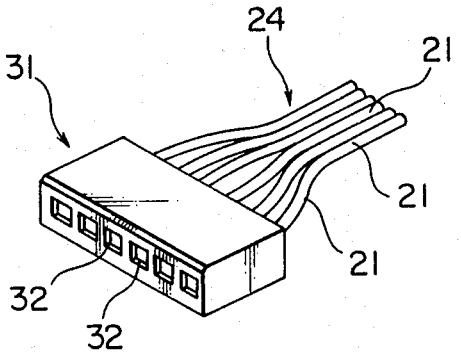
FIG. 7 is a perspective view illustrating how the conventional crimp terminals are built in a socket housing.

FIG. 1 to FIG. 5 illustrate an embodiment of the crimp connector according to the present invention. In the drawings, the same numerals are applied to the members substantially the same as those in FIG. 6 and FIG. 7 mentioned above.

A crimp terminal 11 used in the present crimp connectors comprises a female contact 12 formed by folding both sides of the front end of a bottom wall 16, a pair of stripped portion holding claws 13 formed by folding both sides of the middle portion of the bottom wall 16 into a U-form, and a pair of unstripped portion holding claws 14 formed by folding both sides of the rear end of the bottom wall 16. An electric wire 21 is so stripped that a core 23 may be exposed to give a stripped portion at its end with a given length. Thus, the stripped portion corresponding to the exposed core 23 and the unstripped portion provided with a cover 22 are disposed at their corresponding upper sites so that they may be inserted between the stripped portion holding claws 13 and the unstripped portion holding claws 14, respectively. Also, a hook 15 formed by a U-form cut is provided in the bottom wall 16 (of the crimp terminal 11) at a portion near to the front. The hook 15 is connected at its front portion to the bottom wall 16, and its rear portion projects from the bottom wall 16, obliquely downward in the shape of a tongue.

Figure 3:
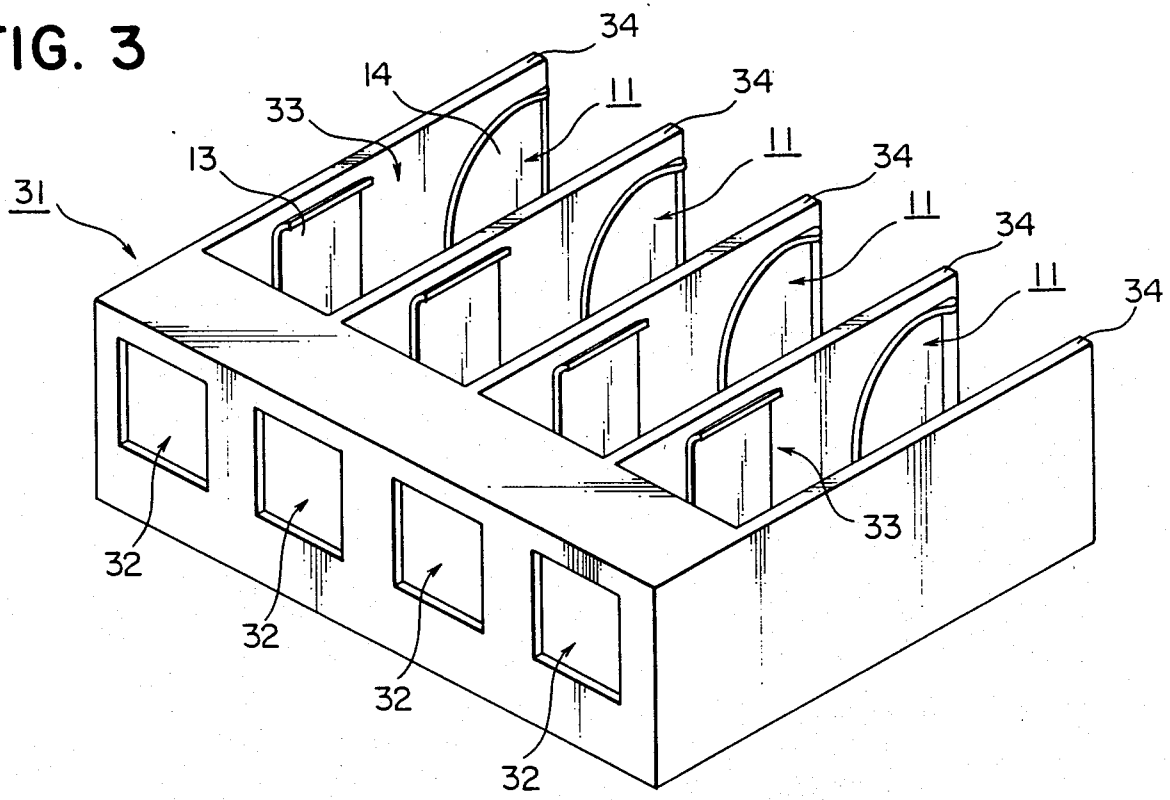
FIG. 3 is a perspective view of the crimp connector.

The crimp terminal 11, as illustrated in FIG. 3, is built in a socket housing 31 to constitute the crimp connector of the present invention. In the instance of the present embodiment, the socket housing 31 has four receiving sections, and crimp terminals 11 are respectively built in the respective receiving sections. At the front end face of the socket housing 31, openings 32 are formed corresponding to the respective receiving sections, and male contacts of another connector (not shown) can be inserted through the openings 32 so that they may be engaged with the above female contact 12. In instances in which male contacts are used as the crimp terminal 11, pins of the male contacts protrude through the openings 32. At the top of the socket housing 31, provided is an opening 33 formed by cutting it away in a U-form from the part somewhat frontward its middle part toward the rear end. The rear end face of the socket housing 31 is also open corresponding to the respective receiving sections. Thus, the borders between the respective receiving sections constitute partition walls 34.

Figure 1:
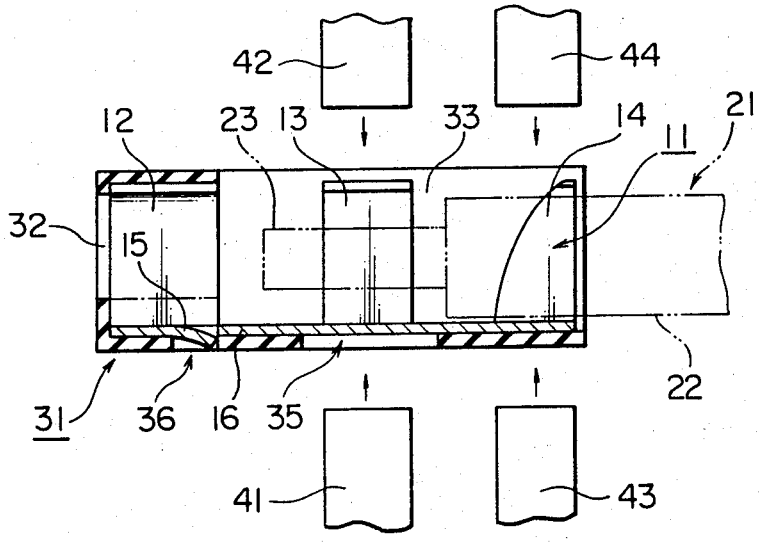
FIG. 1 is a cross section illustrating an embodiment of the crimp connector according to the present invention.

To make reference to FIG. 1 together, an opening 35 is formed at the bottom of the socket housing 31, corresponding to the part of the bottom wall 16 of the crimp terminal 11 at which part the stripped portion holding claws 13 are provided. An anvil 41 to crimp the stripped portion holding claws 13 is so designed as to be inserted through this opening 35. A crimper 42 to crimp the stripped portion holding claws 13 in a synchronous motion with this anvil 41, is also so designed as to be inserted through the top opening 33 of the socket housing 31. On the other hand, an anvil 43 to crimp the unstripped portion holding claws 14 is so designed as to be brought into face-to-face contact with the bottom of the socket housing 32 corresponding to the position at which the unstripped portion holding claws 14 are provided. Further, a crimper 44 to crimp the unstripped portion holding claw 14 in a synchronous motion with the anvil 43, is so designed as to be inserted through the top opening 33 of the socket housing 31. The anvils 41 and 43 are made integral at their lower portions, and the crimpers 42 and 44 are made integral at their upper portions. Consequently the crimping motion by the anvil 41 and crimper 42 and the crimping motion by the anvil 43 and crimper 44 are so controlled as to be synchronous via a toggle mechanism or the like (not shown) using a driving source such as a cylinder mechanism (not shown).

At the bottom of the socket housing 31, an opening 36 is further provided corresponding to the hook 15 provided at the part near to the front of the bottom wall 16 of the crimp terminal 11 so that the hook 15 may be engaged with the opening 36 to prevent dislocation of the crimp terminal when the crimp terminal 11 has been inserted into the socket housing 31. The structure with which the crimp terminal 11 and the socket housing 31 are assembled may not be limited to the structure as described above, and there can be employed various structures as exemplified by the structure in which a protuberance formed in the bottom wall 16 of the socket housing 31 is engaged with an opening formed in the bottom wall 16 of the crimp terminal 11, and the structure in which the crimp terminal 11 and socket housing 31 are integrally formed.

Description will be made below about the procedures to secure the crimp terminals of the above crimp connector to wires.

Figure 2:
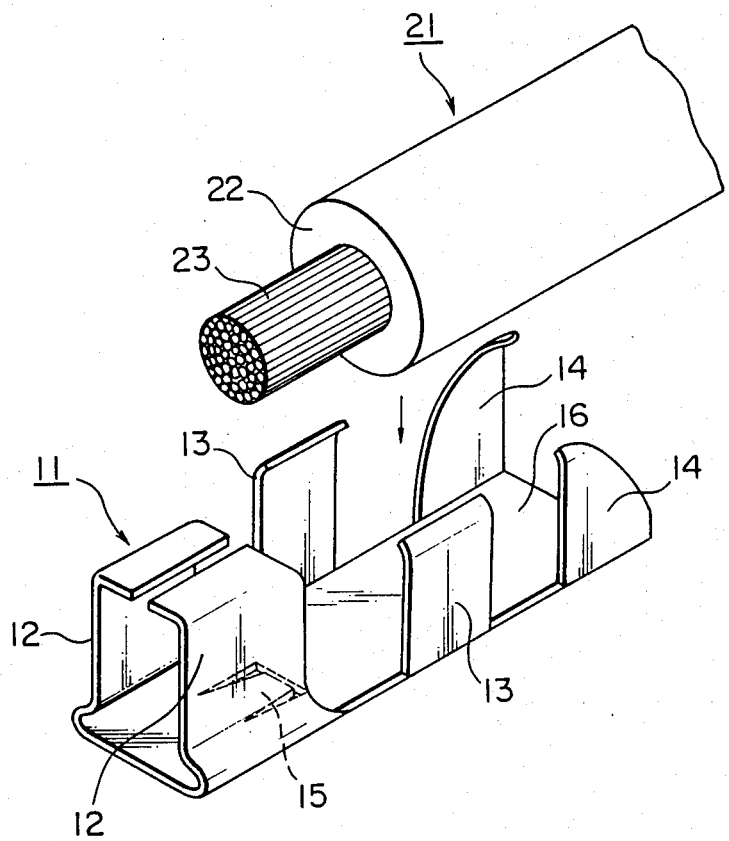
FIG. 2 is a perspective view illustrating a crimp terminal used in the crimp connector, in the state that the former is taken out from the latter.

This crimp connector is fed in the state that the crimp terminal 11 and the socket housing 31 have been beforehand assembled. The wire 21 is fed in the state that its end has been stripped with a given length with its core 23 exposed. The wire 21 is positioned above the crimp connector in such a state as illustrated in FIG. 2 (provided that the socket housing 31 is omitted in FIG. 2), and this wire is brought down from that state before it is supported in the manner that the stripped portion 23 of the wire 21 enters between the stripped portion holding claws 13 and the part provided with the cover 22 enters between the unstripped portion holding claws 14.

With this state, the crimpers 42 and 44 shown in FIG. 1 are brought down by means of a driving mechanism (not shown) and also the anvils 41 and 43 are brought up. The crimpers 42 and 44 force down the wire 21 so that it may be inserted to the above predetermined position of the crimp terminal 11, and also the crimper 42 collides against the stripped portion holding claws 13 and the crimper 44 collides against the unstripped portion holding claws 14. At the same time, the anvil 41 goes through the opening 35 provided at the bottom of the socket housing 31 to come into collision with the bottom wall 16 of the crimp terminal 11 and the anvil 43 comes into collision with the bottom of the socket housing 31.

Figure 4:
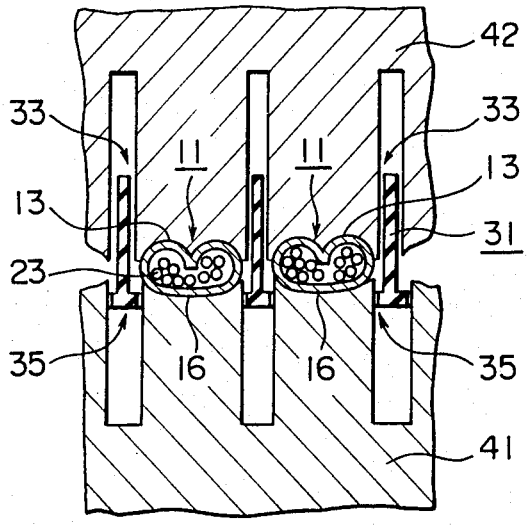
FIG. 4 is a cross section illustrating how the claws for holding stripped portions of wires have been crimped in the crimp connector.

As illustrated in FIG. 4, the anvil 41 comprises a plurality of teeth that are respectively inserted to the openings 35 corresponding to the respective receiving sections of the socket housing 31, and the teeth each have the shape of a gently concave arc on their top surfaces. The crimper 42 also comprises a plurality of teeth that are respectively inserted to the openings 33 corresponding to the respective receiving sections of the socket housing 31, and the teeth each have the shape like double-linked concave arcs on their bottom surfaces. Then, the anvil 41 and crimper 42 hold therebetween the part to be crimped with the stripped portion holding claws 13 of the crimp terminal 11, so that the stripped portion holding claws 13 are crimped as illustrated in FIG. 4, and thus the stripped portion 23 of the wire is firmly held. This crimping results in application of a fairly strong force, but it may not occur that the socket housing 31 is broken, since the anvil 41 and crimper 42 directly act on the crimp terminal 11.

Figure 5:
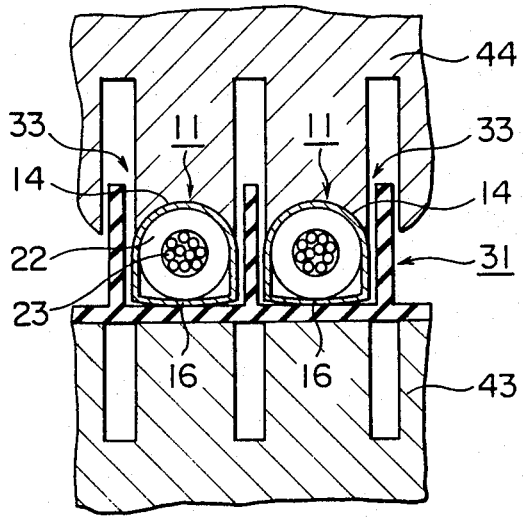
FIG. 5 is a cross section illustrating how the claws for holding unstripped portions of wires have been crimped.

Also, as illustrated in FIG. 5, the anvil 43 comprises a plurality of teeth that are respectively brought into face-to-face contact with the bottom corresponding to the respective receiving sections of the socket housing 31, and the teeth are each flat on their top surfaces. The crimper 44 also comprises a plurality of teeth that are inserted to the openings 33 corresponding to the respective receiving sections of the socket housing 31, and the teeth each have the shape of a concave arc on their bottom surfaces. Then, the anvil 43 and crimper 44 hold therebetween the part to be crimped with the unstripped portion holding claws 14 of the crimp terminal 11, so that the unstripped portion holding claws 14 are crimped as illustrated in FIG. 5, and thus the unstripped portion 22 of the wire 21 is firmly held. Since this crimping force is relieved owing to the cover 22 of the wire 21, it may not occur that the socket housing 31 is broken even if the anvil 43 comes into collision with the bottom of the socket housing 31. The crimper 44 may alternatively have the shape like doublelinked concave arcs on their bottom surfaces, like the crimper 42 to crimp the stripped portion holding claws 13.

As described above, the present invention makes it possible to attach wires in the state that crimp terminals have been built in a socket housing, so that the operation to attach the crimp connector can be simplified and can be made suited to automatization.

What is claimed is:

1. A crimp connector, comprising a socket housing having received therein a crimp terminal comprising a contact, at least a pair of claws for holding a stripped portion of a wire, and at least a pair of claws for holding an unstripped portion of the wire, said housing being provided;

at a front end face thereof with an opening for said contact;

at a top thereof with an opening through which the wire is inserted and crimpers to crimp the stripped portion holding claws and the unstripped portion holding claws are inserted; and at a bottom thereof with an opening through which an anvil to crimp said stripped portion holding claws is inserted.

2. The crimp connector according to claim 1, wherein said socket housing comprises a plurality of receiving sections in which a corresponding number of said crimp terminals have been received.

3. The crimp connector according to claim 1, wherein a means to prevent dislocation between said crimp terminal and said socket housing is provided.

4. The crimp connector according to claim 1, wherein said contact comprises a female contact or a male contact.

5. A method of attaching a wire to a crimp connector, comprising;

disposing a wire whose end portion has been stripped with a given length to have a stripped portion and an unstripped portion, in a crimp connector comprising a socket housing having received therein a contact, at least a pair of stripped portion holding claws and at least a pair of unstripped portion holding claws, in such a manner that the stripped portion may be positioned at an upper site of said stripped portion holding claws and the unstripped portion may be positioned at an upper site of said unstripped portion holding claws;

inserting an anvil to crimp said stripped portion holding claws, through a bottom opening provided at the bottom of said socket housing; and bringing an anvil to crimp said unstripped portion holding claws, into face-to-face contact with the bottom of said socket housing;

simultaneously inserting a crimper to crimp said stripped portion holding claws and a crimper to crimp said unstripped portion holding claws, through a top opening provided at the top of said socket housing, while forcing down said wire; and crimping said stripped portion holding claws so that said stripped portion of the wire may be held therewith, and crimping said unstripped portion holding claws so that said unstripped portion of the wire may be held therewith.

6. The method according to claim 5, wherein said socket housing comprises a plurality of receiving sections in which a corresponding number of said crimp terminal have been received, and said anvils and said crimps comprise a plurality of teeth corresponding to the plurality of the receiving sections.

* * * * *